United States Patent [19]

Behrens

[11] Patent Number: 4,852,672

[45] Date of Patent: Aug. 1, 1989

[54] DRILL APPARATUS HAVING A PRIMARY DRILL AND A PILOT DRILL

[76] Inventor: Robert N. Behrens, 4802 W. Laurel La., Glendale, Ariz. 85304

[21] Appl. No.: 231,953

[22] Filed: Aug. 15, 1988

[51] Int. Cl.[4] ..... E21B 10/26; E21B 10/36; E21B 17/18

[52] U.S. Cl. ..... 175/389; 175/135; 175/215; 175/320; 175/415; 175/418

[58] Field of Search ..... 175/389, 390, 386, 393, 175/414, 415, 417, 418, 419, 257, 320, 321, 135, 293; 173/132, 78, 80

[56] References Cited

U.S. PATENT DOCUMENTS

| | | | |
|---|---|---|---|
| 1,746,455 | 2/1930 | Woodruff et al. . | |
| 2,046,106 | 6/1936 | Bozeman | 175/257 X |
| 2,080,526 | 5/1937 | Bedford | 81/3 |
| 2,191,699 | 2/1940 | Stephens . . | |
| 3,047,082 | 7/1962 | Brown | 175/415 |
| 3,227,230 | 1/1966 | Lagerstrom | 175/389 X |
| 3,231,032 | 1/1966 | Genberg et al. | 175/389 X |
| 3,259,403 | 7/1966 | Hjalsten et al. | 175/215 X |
| 3,613,807 | 10/1971 | Gallis | 175/209 |
| 3,682,260 | 8/1972 | Klemm | 175/92 |

FOREIGN PATENT DOCUMENTS

| | | | |
|---|---|---|---|
| 270537 | 4/1969 | Austria | 175/389 |
| 817248 | 3/1981 | U.S.S.R. | 175/390 |
| 1068638 | 5/1967 | United Kingdom | 175/257 |

*Primary Examiner*—Hoang C. Dang
*Attorney, Agent, or Firm*—H. Gordon Shields

[57] ABSTRACT

Drill steel or bit apparatus includes a primary drill bit having a base and a stem, a drill tip, and a bore extending longitudinally through the base, the stem, and the tip, and a pilot drill bit having a base and a stem, and a tip, and the stem and the tip extend through the longitudinal bore in the primary drill bit. The pilot drill bit includes a longitudinally extending bore through which compressed air flows. The base of the pilot drill bit is impacted by a drill piston and the base of the pilot drill bit in turn impacts the primary drill bit. Drilling is accomplished by the tips of both the pilot drill and the primary drill bit.

6 Claims, 1 Drawing Sheet

10
84
80
82
3
3
26
22
20
60
4
4
30
6
36
40
5
42
34
38
5
6

30
32
64
36
38
34
40
48
42
44
92
46

26
60
100
90
22

100
60
30
90
32

64
36
38
34
32
40
62
66
48
42
44
58
46

84
80
82
86
90
8
102
104
92
8
60
24
20
26
60
30
32
64
38
36
34

100
90
60
32
102
66
62
38
92
104
34

80
90
100
102
106
108
104
92

DRILL APPARATUS HAVING A PRIMARY DRILL AND A PILOT DRILL

BACKGROUND OF THE INVENTION

1. Field of the Invention

This invention relates to drill bits, and, more particularly, to drill bits normally used for drilling in concrete and the like.

2. Description of the Prior Art

Prior art drill bits typically used to drill in concrete and the like, and which are used in pneumatic drills, generally include a rear base having flats adapted to secure the drill bit in a drill chuck. The end of the drill bit or drill steel, as it is sometimes referred to, is impacted by a piston pneumatically actuated in the pneumatic drill. The repetitive hammering by the drill bit, or by the point of the drill element, then fractures or chips away the concrete to make a hole. The drill steel rotates as it impacts in the concrete.

The drill steel or drill bit generally includes a bore through which compressed air flows to the bit portion at the tip of the drill bit for purposes of cleaning out the hole being made by the drill tip. The bit portion generally has a slightly larger diameter than does the stem, and there are typically flutes or slots in the bit portion through which the debris from the concrete being drilled is expelled rearwardly and out of the hole being drilled.

Typically, the bit portion consists of a plurality of tip elements using carbide points or tips perform the actual drilling or cutting operation. There may be four or six or more such carbide tips, depending on the particular drill bit design.

There may be slight variations of the drill bit described in the preceding paragraphs. However, there have been no substantial changes in the basic drill bit or drill elements since the advent of pneumatic drill many decades ago. Obviously, there will be differences in lengths and in the diameters of the drill bits, depending on the size of the drills used and the holes to be drilled, both in terms of diameter and length, and there may be variations due to a particular chuck design or due to the size of the pneumatic drill to which the drill bit or steel will be secured.

The carbide drill tips generally wear out long before the rest of the drill bit wears out. In some cases, the carbide tipes may be replaced, but more generally the entire drill bit is discarded in favor of a new drill bit.

When a rock is encountered in drilling a hole, the tendency of the drill bit is to veer away from the rock and to take the path of least resistance, or an area where a rock is not encountered. This, of course, effects the accuracy of the hole being drilled, and is accordingly an undesirable occurrence.

U.S. Pat. No. 1,746,455 (Woodruff et al) discloses a drill bit which includes a pilot blade disposed centrally between a plurality of cutting blades. The pilot blade rotates through a multi-stepped cam system.

U.S. Pat. No. 2,080,526 (Bedford) discloses a device for holding a drill bit. The apparatus includes a socket system which includes air passages, both axially extending and radially extending.

U.S. Pat. No. 2,191,699 (Stephens) discloses a rock drill which includes a threaded engagement between the drill shank and a drill bit.

U.S. Pat. No. 3,047,082 (Brown) discloses a masonry drill designed particularly for use in a hand-held pneumatic drill. The drill includes a particular tip design. The specific design of the tip enhances the use of the apparatus in drilling concrete and the like.

It will be noted that in U.S. Pat. No. 3,047,082 patent there is no provision for the use of compressed air to blow away debris from the hole being drilled, as is present with all of the other drills discussed herein.

U.S. Pat. No. 3,613,807 (Galis) discloses a drill rod designed for use with percussion (pneumatic) type drills. The patent is particularly concerned with the drill tip and with the removal of dust or debris from the hole being drilled. Suction is applied to pull the dust and debris away from the tip, as opposed to the more common compressed air system of blowing the dust and debris out of the hole being drilled.

U.S. Pat. No. 3,682,260 (Klemm) discloses a rotary percussion drill utilizing a plurality of impact elements drilling within a casement. The apparatus is designed for deep vertical drilling in which outer casement members are continuously added as drilling proceeds. A down-the-hole hammer is utilized.

In the apparatus of the present invention, a center, pilot drill is utilized. The pilot drill makes first contact with the concrete to be drilled, and the primary drill, coaxially related to the pilot drill, then impacts the concrete to be drilled. The result is that a hole is drilled more rapidly and more efficiently and more accurately than is possible with the drill bits of the prior art. If or when a rock is encountered, the pilot drill virtually drills straight ahead and thus shatters the rock, and does not allow the primary drill to be moved or to veer away from the rock. Moreover, with the pilot drill centered in the hole being drilled, debris is generally moved out of the way of the primary drill, thus helping to increase the efficiency of the primary drill and of the carbide tip thereon.

SUMMARY OF THE INVENTION

The invention described and claimed herein comprises drill apparatus having a primary drill and a pilot drill disposed within the primary drill. The pilot drill is movable in a bore within the primary drill. The base of the pilot drill is impacted by the piston of the pneumatic drill and the pilot drill impacts the primary drill.

Among the objects of the present invention are the following:

To provide new and useful drill bit apparatus;

To provide new and useful drill steel apparatus for a pneumatic drill;

To provide new and useful drill bit apparatus having a pilot drill and a primary drill;

To provide new and useful drill bit apparatus including a primary drill bit having a bore and a pilot drill bit disposed within the bore of the primary drill bit;

To provide new and useful drill steel apparatus having a pilot drill bit impacted by a pneumatic drill piston and a primary drill bit impacted by the pilot drill bit; and To provide new and useful drill bit apparatus utilizing a pilot drill bit and a primary drill bit, both of which include passages for compressed air.

DESCRIPTION OF THE PREFERRED EMBODIMENT

Figures 1, 2, 3, 4, 5, 6, 7, 8:
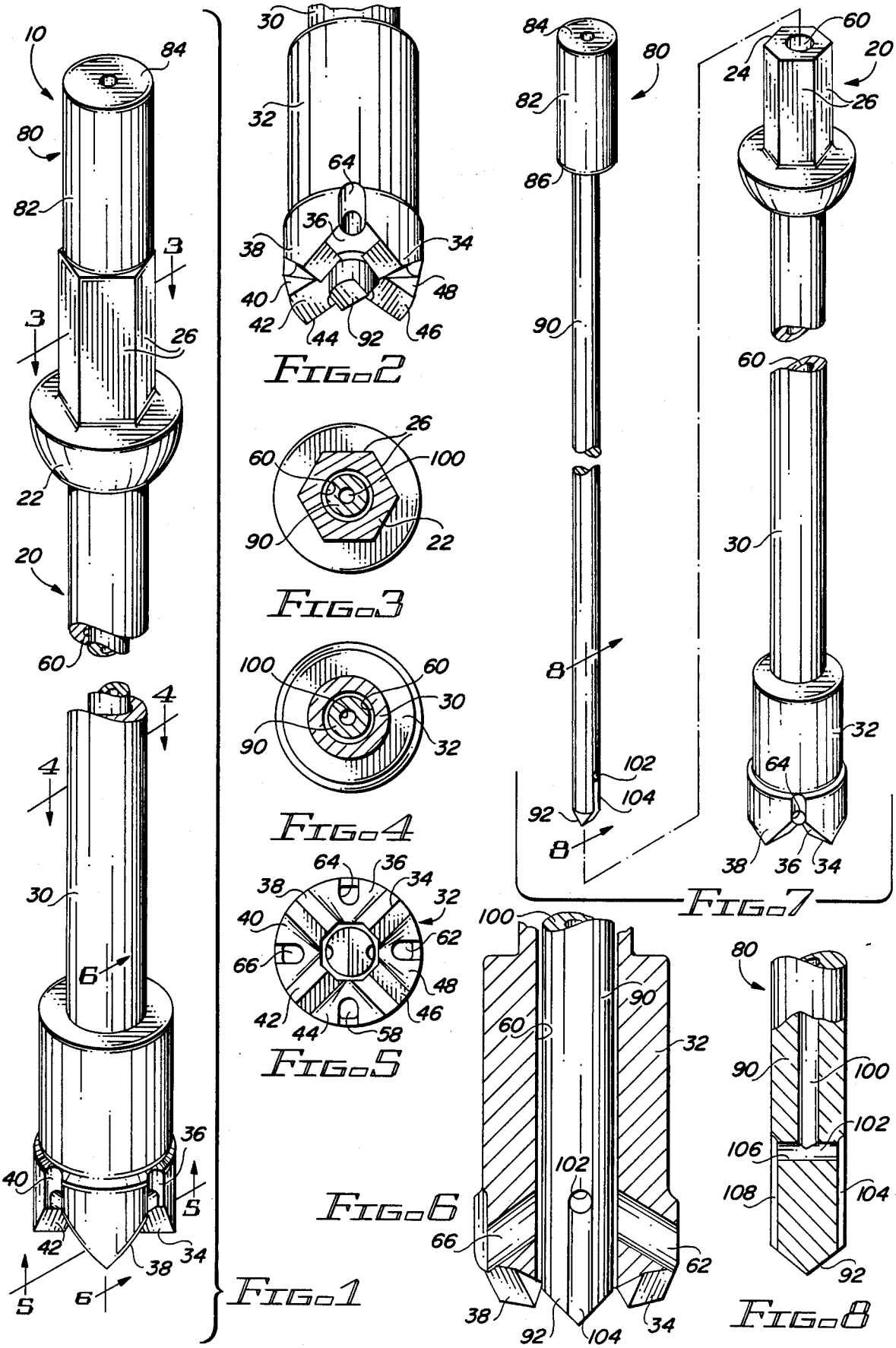
FIG. 1 is a perspective view, partially broken away, of the apparatus of the present invention.
FIG. 2 is a perspective view of a portion of the apparatus of the present invention.
FIG. 3 is a view in partial section taken generally along line 3—3 of FIG. 1.
FIG. 4 is a view in partial section taken generally along line 4—4 of FIG. 1.
FIG. 5 is a view in partial section taken generally along line 5—5 of FIG. 1.
FIG. 6 is a view in partial section taken generally along line 6—6 of FIG. 1.
FIG. 7 is an exploded perspective view of the apparatus of the present invention.
FIG. 8 is a view in partial section taken generally along line 8—8 of FIG. 7.

FIG. 1 is a perspective view of drill steel or drill bit apparatus 10 of the present invention. Drill bit or drill steel apparatus 10 generally includes two portions, a primary drill bit portion 20 and a pilot drill bit portion 80. The primary drill bit portion 20 includes a base 22 and a stem 30, and a bit portion 32. The base 22 includes a rear impact face 24 (See FIG. 7) which receives impact or percussion forces to provide the drilling action. The exterior of the base 20 includes a plurality of flats 26. Generally, the flats are six in number to fit into typical chucks in pneumatic drills. Obviously, the number of flats may vary, and/or the shape of the base 22 may vary, depending on the design of a particular chuck of a particular drill.

FIG. 2 is a perspective view of the front portion of the bit portion 32. FIG. 3 is a view in partial section through the base 22 of the apparatus 10, taken generally along line 3—3 of FIG. 1. FIG. 4 is a view in partial section through the stem 30 of the drill apparatus 10, taken generally along line 4-4 of FIG. 1. FIG. 5 is a front view of the bit portion 32, taken generally along line 5—5 of FIG. 1.

FIG. 6 is a view in partial section of the bit portion 32, taken generally along line 6—6 of FIG. 1. FIG. 7 is an exploded perspective view showing the primary drill bit 20 and the pilot drill bit 80 separated from each other. FIG. 8 is a view in partial section of a portion of the pilot drill bit 80 taken generally along line 8—8 of FIG. 7. For the following discussion, reference will generally be made to all of the Figures in the drawing.

The stem 30 is generally of an elongated cylindrical configuration extending, from the base 22 to the bit portion 32 which actually accomplishes the drilling. At the front of the stem 30 is a drill bit portion 32. The drill bit portion 32 includes a plurality of drill tips, namely four, as shown for the apparatus 10. The drill bit portion 32 includes a drill tip 34, a drill tip 38, a drill tip 42, and a drill tip 46. The drill bit portion 32 also contains a plurality of slots. Four slots 36, 40, 44, and 48 are illustrated. It will be noted that the drill tips 34, 38, 42 and 48 extend generally radially away from the central bore 60, and that the slots 36, 40, 44, and 48 taper away from an axially extending bore 60 between the drill points and extend generally outwardly and downwardly. The slots 30 . . . 48 help to conduct debris, dust, and the like, away from the drill tips and from the pilot drill 80.

The bore 60 extends generally axially through the primary drill 20 from the impact face 24 at the rear of the primary drill 30 to the drill tips 34 . . . 44. The bore 60 receives the pilot drill 80, and it also comprises a conduit for compressed air, as will be discussed below.

Four connecting bores 62, 64, 66 and 68 extend between the bore 60 and the respective slots 36, 40, 44, and 48. The connecting bores 62 . . . 68 extend radially downwardly and outwardly from the center bore 60. Compressed air flows from the bore 60 through the connecting bores 62 . . . 68 to the slots 36 . . . 48 to help blow away the debris, dust, etc. from the hole being drilled. Obviously, the size (diameter) of a particular bit will allow fewer or greater slots and connecting bores to be used.

The pilot drill 80 includes a base 82 and a stem 90. The base 82 includes a rear impact face 84 and a front impact face 86. The stem 90 extends forwardly from the base 82, generally coaxially aligned with the base 82.

The base 82 is shown generally cylindrically in configuration, and of a lesser diameter than the base 22. Thus, while the base 22 is securely disposed in a chuck (not shown) the pilot drill 80, and its base 82, are relatively freely movable within the chuck holding the primary drill 20.

In operation, a piston from the drill (not shown) contacts the rear impact face 84 of the base 82. The front impact face 86 in turn contacts the impact face 24 of the base 22 of the primary drill 20.

The stem 90 has an outer diameter less than the inner diameter of the bore 60, and accordingly moves freely within the bore 60. Obviously, the diameter of the base 82 is substantially greater than the diameter of the bore 60.

At the outer end of the stem 90, remote from the base 82, is a drill tip 92. Extending longitudinally through pilot drill 80 is a bore 100. The bore 100 extends through the base 82 and terminates adjacent to the drill tip 92. A pair of radially extending bores 102 and 106 connect the exterior of the stem 90 with the bore 100 adjacent to the tip 92. A relatively shallow slot 104 extends on the outer portion of the shank 90 from the bore 102 axially to the tip 92. A similar slot 108 extends from the bore 106 to the tip 92.

Compressed air flows through the bore 100 and out of the shank 90 through the bores 102 and 106. The slots 104 and 108 help to conduct compressed air forwardly from the bores 102 and 106 to help move the debris away from the hole being drilled, and thus away from the tip 92 and also away from the drill tips 34 . . . 44.

The apparatus described above comprises a double drill bit designed primarily for drilling in concrete by a pneumatic drill. The pilot drill, extending longitudinally in the center of the primary drill bit, is freely floating, and acts as a pilot drill for the larger drill bit portion of the primary drill. This aids in the drilling by making the drill bit portion of the primary drill more efficient.

It will also be noted that the tip 92 of the primary drill 80 is illustrated as being of the same size as the stem 90. However, it will be understood that the drill tip 92 may be larger than the stem 90, if desired.

It will also be noted that the rotation of the primary drill bit 20 has not been discussed. However, it will be understood, as is well known in the art, that drill bits for pneumatic drills typically rotate. The rotation is generally in a counterclockwise direction. The drill bit portion 32 of the primary drill may accordingly be threaded onto the stem 30 with left-handed threads, if desired. Similarly, the tip 92 of the pilot drill 80 could also be appropriately threaded onto the stem 90.

Finally, it will be noted that the apparatus has been discussed in terms of a pneumatic drill. The apparatus could also be used with an electric percussion reciprocating hammer drill, as well as with pneumatic drills. With electronic reciprocating hammer drill, the percussion kicks out broken pieces of concrete up to certain depths. After those certain depths are reached, then air is needed to blow out the residue from the drilling operation.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Drill bit apparatus, comprising, in combination:

primary drill bit means for drilling holes, including first base means for securing the primary drill bit means a drill chuck, said first base means having an axially extending portion having flat surfaces thereon adapted to be received by said drill chuck, a first stem portion connected to the first base means, drill tip means connected to the stem portion and including a plurality of drill tips, and slots disposed between the drill tips of the plurality of drill tips, and first bore means extending through the first base means, the stem portion, and the drill tip means through which compressed air flows; and pilot drill means, including second base means having a rear impact face for receiving an impact for drilling and a front impact face for impacting the first base means of the primary drill bit means, a second stem portion connected to the second base means and extending through the bore means of the primary drill bit means, a tip connected to the second stem portion remote from the second base means and extending outwardly from the drill tip means of the primary drill bit means, and second bore means extending through the second base means and the second stem portion through which compressed air flows to blow dust and debris from the hole being drilled.

2. The apparatus of claim 1 in which the first base means includes a rear impact face for impacting against the front impact face of the second base means.

3. The apparatus of claim 2 in which the first bore means includes a first bore extending longitudinally through the first base means, the first stem portion, and the drill tip means and a plurality of connecting bores extending from the first bore to the slots through which compressed air flows to the slots for blowing dust and debris from the hole being drilled.

4. The apparatus of claim 3 in which the second bore means includes a second bore extending longitudinally through the second base means to the tip and the second stem portion and at least a single radial bore extending from the second bore to the exterior of the second stem adjacent to the tip through which compressed air flows.

5. The apparatus of claim 4 in which the pilot drill means further includes a slot extending from the exterior of the second stem portion to the tip to allow compressed air to flow from the second bore and the radial bore.

6. The apparatus of claim 1 in which the first bore means has a first interior diameter and the second stem means has a first exterior diameter and the first interior diameter is greater than the first external diameter to allow the second stem portion of the primary drill bit means to move freely in the first bore means and to allow compressed air to flow freely in the first bore means.

* * * * *